US010916836B2

(12) United States Patent
Thiam et al.

(10) Patent No.: US 10,916,836 B2
(45) Date of Patent: Feb. 9, 2021

(54) VEHICULAR ANTENNA ASSEMBLY INCLUDING GNSS ANTENNA AND SDARS ANTENNA WITH REFLECTOR

(71) Applicant: Laird Technologies, Inc., Chesterfield, MO (US)

(72) Inventors: Cheikh T. Thiam, Grand Blanc, MI (US); Ayman Duzdar, Holly, MI (US); Reza Azadegan, Troy, MI (US); Curtis W. Beaulieu, Fenton, MI (US); Hasan Yasin, Grand Blanc, MI (US); Thomas W. Howay, Metamora, MI (US)

( * ) Notice: Subject to any disclaimer, the term of this patent is extended or adjusted under 35 U.S.C. 154(b) by 41 days.

(21) Appl. No.: 16/261,356

(22) Filed: Jan. 29, 2019

(65) Prior Publication Data

US 2019/0237860 A1 Aug. 1, 2019

Related U.S. Application Data

(60) Provisional application No. 62/623,761, filed on Jan. 30, 2018.

(51) Int. Cl.

| | |
|---|---|
| ***H01Q 1/32*** | (2006.01) |
| ***H01Q 21/06*** | (2006.01) |
| ***H01Q 15/14*** | (2006.01) |
| ***H01Q 5/50*** | (2015.01) |

(52) U.S. Cl.

CPC ..... *H01Q 1/3233* (2013.01); *H01Q 5/50* (2015.01); *H01Q 15/14* (2013.01); *H01Q 21/065* (2013.01)

(58) Field of Classification Search

None

See application file for complete search history.

(56) References Cited

U.S. PATENT DOCUMENTS

| | | | | |
|---|---|---|---|---|
| 7,492,318 | B2 | 2/2009 | Duzdar et al. | |
| 7,492,319 | B2 | 2/2009 | Lindackers et al. | |
| 2008/0100521 | A1 | 5/2008 | Herbert et al. | |
| 2014/0002305 | A1* | 1/2014 | Hsu | H01Q 9/0407 342/368 |
| 2014/0292593 | A1* | 10/2014 | Thiam | H01Q 9/0421 343/713 |
| 2018/0083348 | A1 | 3/2018 | Thiam et al. | |
| 2019/0006733 | A1 | 1/2019 | Yasin et al. | |
| 2019/0006765 | A1* | 1/2019 | Chien | H01Q 15/14 |

FOREIGN PATENT DOCUMENTS

| | | | |
|---|---|---|---|
| WO | WO-2018053392 | A1 | 3/2018 |

* cited by examiner

*Primary Examiner* — Jany Richardson

(74) *Attorney, Agent, or Firm* — Harness, Dickey & Pierce, P.L.C.; Anthony G. Fussner

(57) ABSTRACT

According to various aspects, disclosed are exemplary embodiments of vehicular antenna assemblies. In an exemplary embodiment, a vehicular antenna assembly generally includes a first satellite antenna configured to be operable for receiving first satellite signals, and a second satellite antenna configured to be operable for receiving second satellite signals different than the first satellite signals received by the first satellite antenna. A reflector is positioned generally between the first and second satellite antennas. The reflector is configured to be operable for reflecting the first satellite signals generally towards the first satellite antenna.

20 Claims, 4 Drawing Sheets

VEHICULAR ANTENNA ASSEMBLY INCLUDING GNSS ANTENNA AND SDARS ANTENNA WITH REFLECTOR

CROSS-REFERENCE TO RELATED APPLICATION

This application claims priority to and the benefit of U.S. Provisional Patent application No. 62/623,761 filed Jan. 30, 2018. The entire disclosure of the above application is incorporated herein by reference.

FIELD

The present disclosure generally relates to a vehicular antenna assembly that includes a GNSS antenna and an SDARS antenna with a reflector.

BACKGROUND

This section provides background information related to the present disclosure which is not necessarily prior art.

Various different types of antennas are used in the automotive industry, including AM/FM radio antennas, Satellite Digital Audio Radio Service (SDARS) antennas (e.g., SiriusXM satellite radio, etc.), Global Navigation Satellite System (GNSS) antennas, cellular antennas, etc. Multiband antenna assemblies are also commonly used in the automotive industry. A multiband antenna assembly typically includes multiple antennas to cover and operate at multiple frequency ranges.

Automotive antennas may be installed or mounted on a vehicle surface, such as the roof, trunk, or hood of the vehicle to help ensure that the antennas have unobstructed views overhead or toward the zenith. The antenna may be connected (e.g., via a coaxial cable, etc.) to one or more electronic devices (e.g., a radio receiver, a touchscreen display, navigation device, cellular phone, etc.) inside the passenger compartment of the vehicle, such that the multiband antenna assembly is operable for transmitting and/or receiving signals to/from the electronic device(s) inside the vehicle.

SUMMARY

This section provides a general summary of the disclosure, and is not a comprehensive disclosure of its full scope or all of its features.

According to various aspects, disclosed are exemplary embodiments of vehicular antenna assemblies. In an exemplary embodiment, a vehicular antenna assembly generally includes a first satellite antenna configured to be operable for receiving first satellite signals, and a second satellite antenna configured to be operable for receiving second satellite signals different than the first satellite signals received by the first satellite antenna. A reflector is positioned generally between the first and second satellite antennas. The reflector is configured to be operable for reflecting the first satellite signals generally towards the first satellite antenna.

In an exemplary embodiment, a stacked patch antenna assembly generally includes a first patch antenna configured to be operable for receiving first signals, a second patch antenna configured to be operable for receiving second signals different than the first signals received by the first patch antenna, and a reflector configured to be operable for reflecting the first signals generally towards the first patch antenna. The second patch antenna may be stacked on top of the first patch antenna such that the reflector is positioned generally between the first and second patch antennas.

Exemplary embodiments are also disclosed of methods relating to a vehicular antenna assembly including first and second patch antennas configured to be operable for receiving respective first and second signals. In an exemplary embodiment, a method generally includes positioning a reflector generally between the first and second patch antennas such that the reflector is operable for reflecting the first signals generally towards the first patch antenna.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
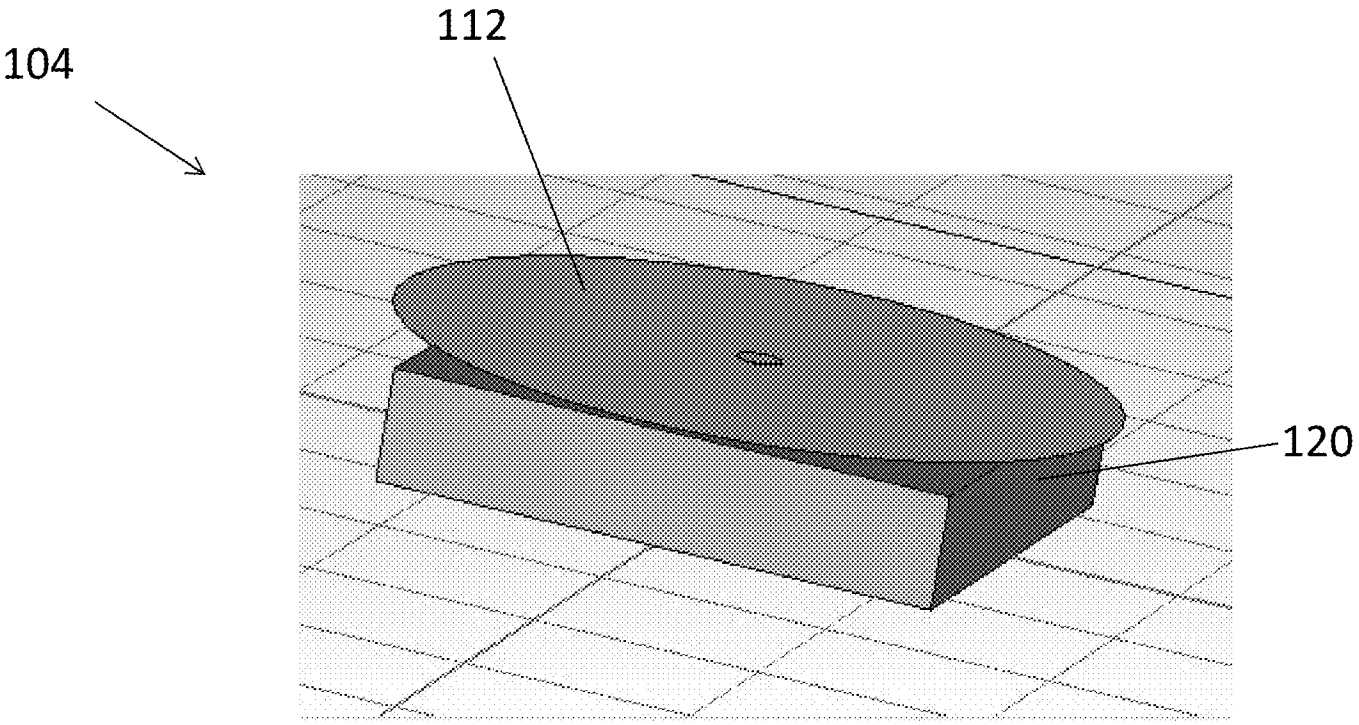
FIG. 2 is a perspective view showing the SDARS patch antenna of FIG. 1 and a reflector according to an exemplary embodiment. The reflector is positioned (e.g., above and/or over the antenna structure or radiating element, etc.) for reflecting, refocusing, and/or directing SDARS signals generally towards the antenna structure or radiating element of the SDARS patch antenna.
Figure 3:
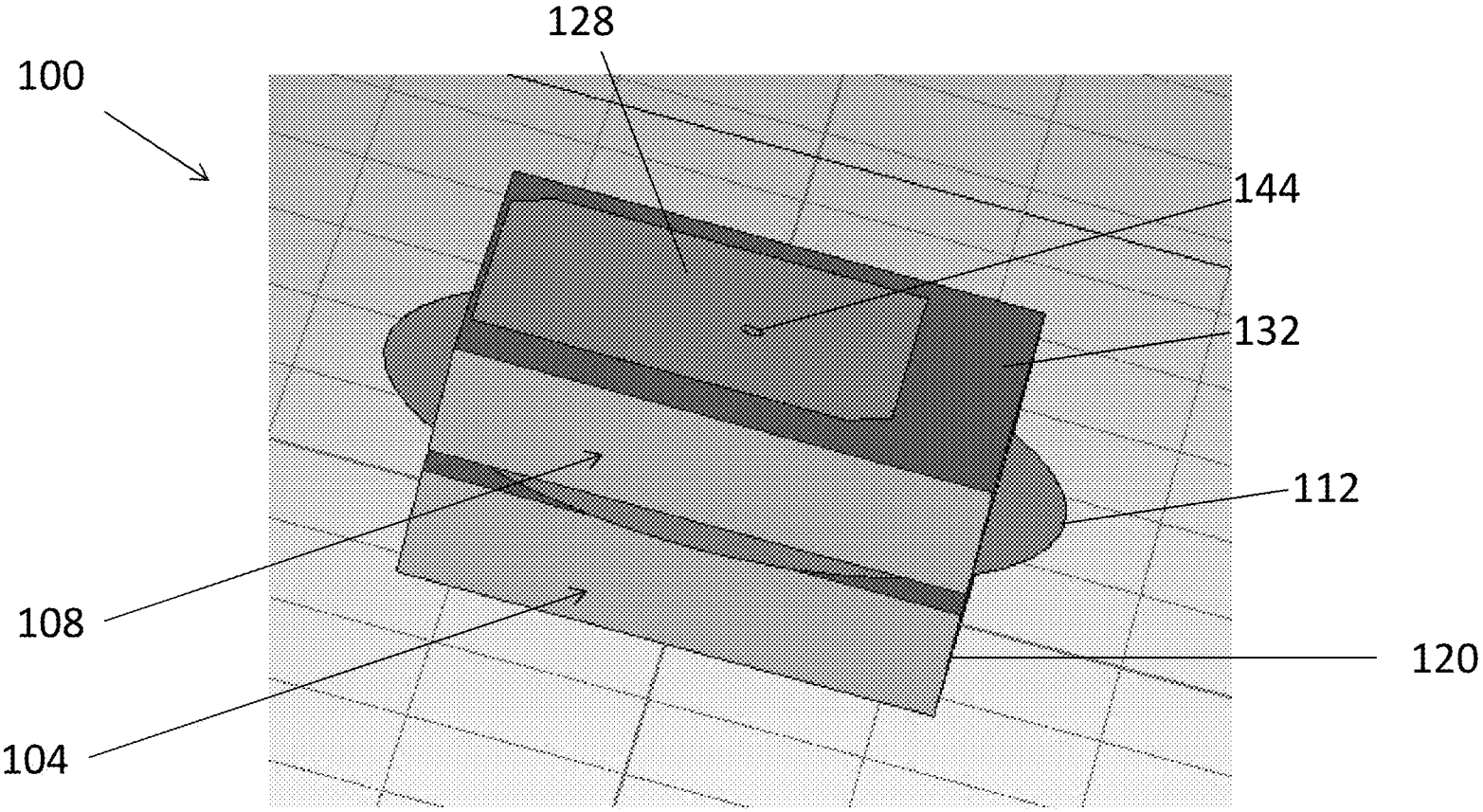

FIG. 3 is a perspective view of an exemplary embodiment of an antenna assembly including the SDARS patch antenna and reflector shown in FIG. 2 and a GNSS patch antenna. The GNSS patch antenna includes an antenna structure or radiating element on a substrate. The GNSS patch antenna is stacked on the SDARS patch antenna such that the reflector is positioned generally between the substrate of the GNSS patch antenna and the antenna structure or radiating element of the SDARS patch antenna.

Figure 4:
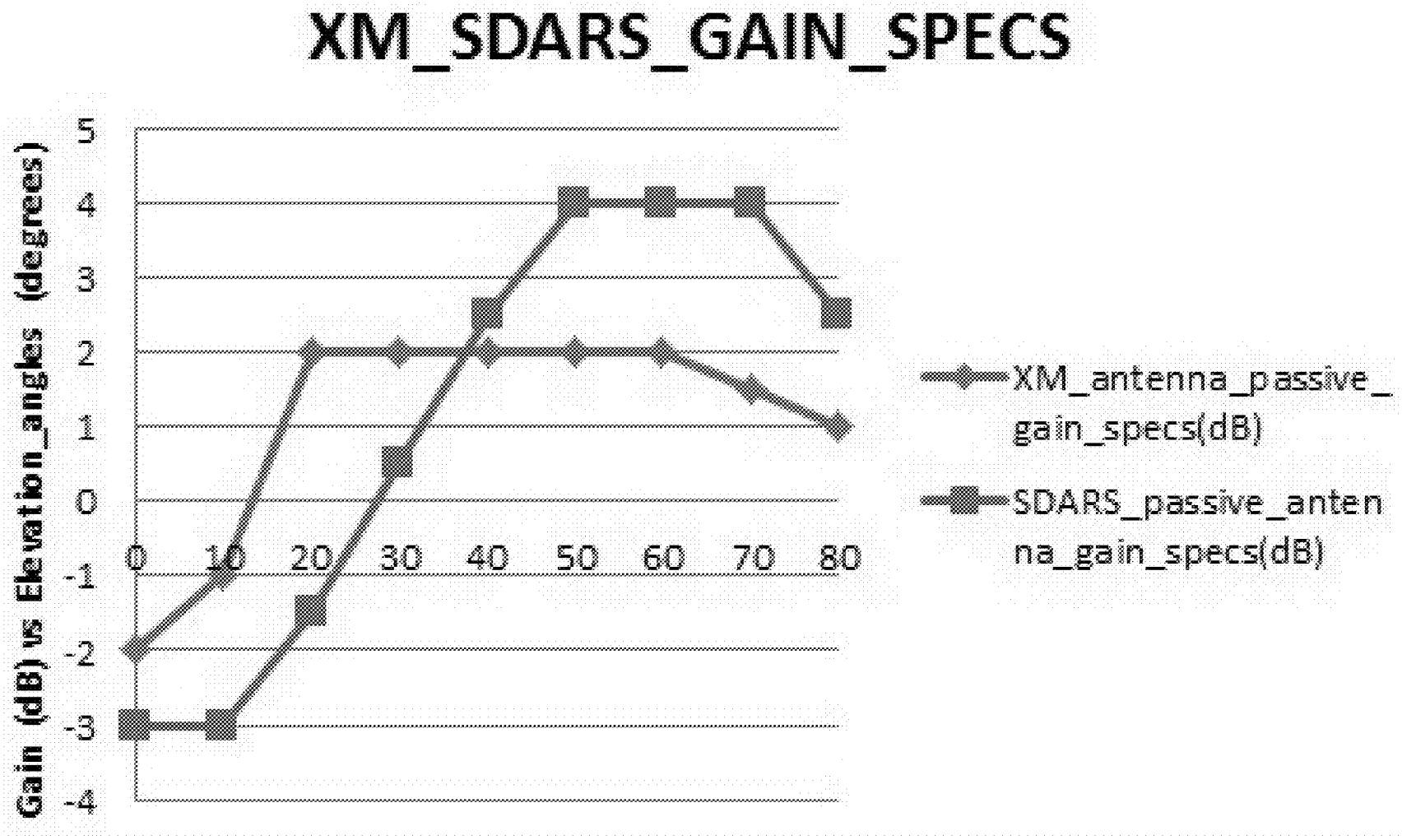

FIG. 4 is a line graphs showing XM and SDARS passive antenna gain specifications in decibels (dB) versus elevation angle in degrees.

Corresponding reference numerals indicate corresponding (but not necessarily identical) parts throughout the several views of the drawings.

DETAILED DESCRIPTION

Example embodiments will now be described more fully with reference to the accompanying drawings.

Exemplary embodiments are disclosed herein of vehicular antenna assemblies that include satellite antennas (e.g., SDARS patch antenna and GNSS patch antenna, etc.) with reflectors (e.g., an electrically-conductive plate, other electrically-conductive parasitic element, etc.) disposed generally between the satellite antennas. In exemplary embodiments, a vehicular antenna assembly generally includes an SDARS (Satellite Digital Audio Radio Service) patch antenna (broadly, a first satellite antenna) with a reflector and a GNSS (Global Navigation Satellite System) patch antenna (broadly, a second satellite antenna).

The SDARS patch antenna includes an antenna structure or radiating element on a substrate. The reflector is positioned (e.g., above and/or over the SDARS antenna structure or radiating element, etc.) for reflecting, refocusing, and/or directing SDARS signals (broadly, satellite signals) generally towards the antenna structure or radiating element of the SDARS patch antenna. The GNSS patch antenna also includes an antenna structure or radiating element on a substrate. The GNSS patch antenna is stacked on the SDARS patch antenna such that the reflector is positioned generally between the substrate of the GNSS patch antenna and the antenna structure or radiating element of the SDARS patch antenna.

The reflector may be configured to be operable for helping increase passive antenna gain at higher elevation angles. But in doing so, the reflector may also decrease passive antenna gain at lower elevation as the total energy radiated is the same, it is just being distributed differently in space. The reflector may thus allow the vehicular antenna assembly to meet or satisfy the interoperable 03 specifications for SiriusXM satellite radio including the passive antenna gain specifications shown in FIG. 4.

Advantageously, the reflector provides a cost effective way to meet the interoperable Sirius-XM 03 specifications for Sirius-XM Satellite Radio without requiring major structural modifications of existing antenna assemblies and without requiring alterations to other antenna functionality (e.g., cellular, GNSS, AM/FM, etc.). The reflector is used to reflect, refocus, and/or direct signals from the satellite(s) to meet the interoperable Sirius-XM 03 specifications. In an exemplary embodiment, a reflector (e.g., a circular electrically-conductive reflector plate, etc.) may be attached to the SDARS patch antenna by using one or more mechanical fasteners (e.g., using a single pan head screw, other mechanical fastener, etc.), adhesive, etc. This exemplary embodiment thus allows the reflector to be attached to the SDARS patch antenna in a relatively quick and simple assembly process.

Exemplary embodiments may allow for implementation of the Sirius-XM 03 specifications without increasing the overall size of the footprint of the antenna assembly. Exemplary embodiments may allow for implementation of the Sirius-XM 03 specifications in a relatively small area (e.g., 25 millimeters by 25 millimeters, etc.) and/or allow for a reduction in the overall size of the antenna assemblies or modules and/or allow for an increase in the number of antennas in the same real estate or overall footprint. In exemplary embodiments, the reflector may allow for an easier integration of SDARS and GNSS (e.g., Global Positioning System (GPS), BeiDou Navigation Satellite System (BDS), the Russian Global Navigation Satellite System (GLONASS), other satellite navigation system frequencies, etc.) for antenna assemblies or modules.

With reference now to the figures, FIG. 3 illustrates a vehicular antenna assembly 100 embodying one or more aspects of the present disclosure. As shown in FIG. 3, the antenna assembly 100 includes an SDARS (Satellite Digital Audio Radio Service) patch antenna 104 (broadly, a first satellite antenna) and a GNSS (Global Navigation Satellite System) patch 108 antenna (broadly, a second satellite antenna).

Figure 1:
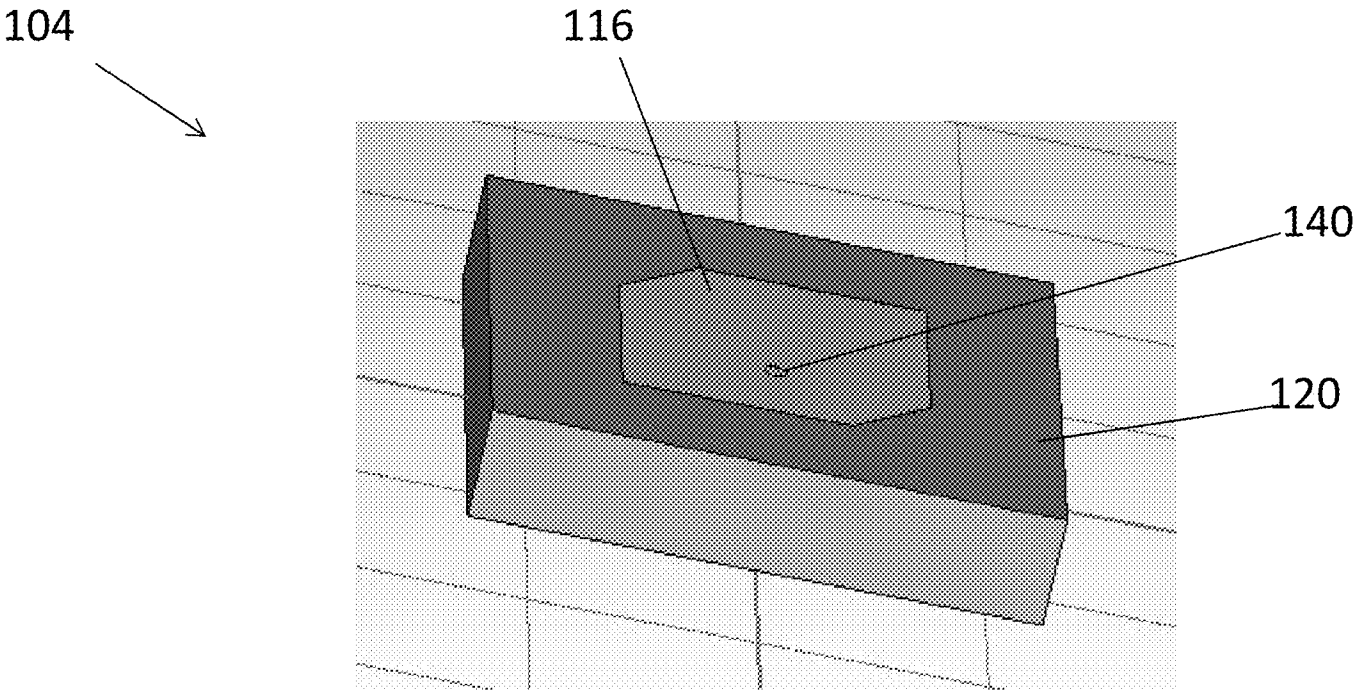
FIG. 1 is a perspective view of an SDARS patch antenna including an antenna structure or radiating element on a substrate according to an exemplary embodiment.

The antenna assembly 100 also includes a reflector 112 for reflecting, refocusing, and/or directing SDARS signals (broadly, satellite signals) generally towards the antenna structure or radiating element 116 (FIG. 1) of the SDARS patch antenna 104. Also shown in FIG. 1, the SDARS patch antenna 104 includes a substrate 120 (e.g., ceramic or other dielectric, etc.) on which is positioned the antenna structure or radiating element 116.

As shown in FIG. 2, the reflector 112 is positioned above and/or over the antenna structure or radiating element 116 for reflecting, refocusing, and/or directing SDARS signals generally towards the antenna structure or radiating element 116 of the SDARS patch antenna 104. In this exemplary embodiment, the reflector 112 may comprise a generally circular electrically-conductive (e.g., metal, etc.) reflector plate that is attached to the SDARS patch antenna 104 by using a mechanical fastener (e.g., a single pan head screw, other mechanical fastener, etc.).

The reflector 112 may comprise a circular or round plate or disk that is relatively flat or thin. The reflector 112 may be configured (e.g., sized, shaped, etc.) such that the reflector's electrically-conductive portion has a footprint or surface area larger than the footprint or surface area of the antenna structure or radiating element 116 (FIG. 1) of the SDARS patch antenna 104. Stated differently, the reflector's electrically-conductive portion may have a footprint or surface area larger than the footprint or surface area of the driven, fed, or excited element 116 of the SDARS patch antenna 104. In some exemplary embodiments, the reflector 112 has an overall footprint or surface area larger than the footprint or surface area of the substrate 120 (e.g., ceramic or other dielectric, etc.) of the SDARS patch antenna 104. Alternative embodiments may include a differently configured reflector or parasitic element (e.g., non-circular, non-metal, larger, smaller, etc.). For example, another exemplary embodiment may include a reflector (e.g., an electrically-conductive parasitic element, director, etc.) that has an electrically-conductive portion with a footprint or surface area smaller than the substrate 120 or smaller than the antenna structure or radiating element 116 of the SDARS patch antenna 104.

As shown in FIG. 3, the GNSS patch antenna 108 includes an antenna structure or radiating element 128 on a substrate 132 ((e.g., ceramic or other dielectric, etc.). In this exemplary embodiment, the GNSS patch antenna 108 is stacked on the SDARS patch antenna 104 such that the reflector 112 is positioned or sandwiched generally between the patch antennas 104, 108, e.g., between the lower surface of the substrate 132 of the GNSS patch antenna 108 and the upper surface of the antenna structure or radiating element 116 of the SDARS patch antenna 104, etc.

As disclosed herein, the reflector 112 is configured (e.g., sized, shaped, located, material, etc.) to be operable for reflecting, refocusing, and/or directing signals received from a satellite(s) generally towards the first satellite antenna 104. In this exemplary embodiment, the first satellite antenna 104 is a patch antenna configured to be operable for receiving SDARS signals (e.g., SiriusXM, etc.). The reflector 112 may comprise a substantially planar or flat electrically-conductive surface that is substantially parallel with and spaced-apart from the antenna structure or radiating element 116 of the patch antenna 104.

In exemplary embodiments, the reflector 112 allows the antenna assembly 100 to satisfy or meet the interoperable 03 specifications for SiriusXM satellite radio including the passive antenna gain specifications shown in FIG. 4. The reflector 112 provides a cost effective way to meet the new 03 specs without requiring major structural modifications to the antenna assembly 100 and without requiring alteration of other antenna functionality (e.g., cellular, GNSS, AM/FM, etc.) of the antenna assembly 100.

As shown in FIG. 4, the XM passive antenna gain specifications require higher gain at lower elevations angles relative to the SDARS passive antenna gain. Conversely, the XM passive antenna gain specifications also require lower gain at higher elevation angles relative to the SDARS passive antenna gain. The reflector 112 helps increase the passive antenna gain at higher elevation angles. But in doing so, the reflector 112 also decreases the passive antenna gain at lower elevation angles as the total energy radiated is the same, it is just being distributed differently in space. For the X-axis (horizontal with elevation angles) in FIG. 4, it should be noted that zero degree along the X axis refers or points to horizon. Conventionally, zero degree is at boresight or Zenith. Accordingly, the angles along the X-axis of the line graph in FIG. 4 are complementary to 90 degrees relative to conventional wisdom.

A wide range of materials may be used for the reflector 112, including metals, metal alloys, etc. In an exemplary embodiment, the reflector 112 comprises an electrically-conductive material (e.g., copper, etc.) on a dielectric substrate (e.g., PCB material, etc.).

Each patch antenna 104, 108 may include a substrate 120, 132 (FIG. 3) made of a dielectric material, for example, a ceramic. An electrically-conductive material may be disposed on the upper surface of the substrates 120, 132 to form the respective antenna structures 116, 128 (e.g., $\lambda/2$-antenna structure, etc.) of the patch antennas 104, 108, respectively. Connectors 140, 144 may connect the respective antenna structures 116, 128 of the patch antennas 104, 108 to a printed circuit board of the antenna assembly 100. A metallization may cover the entire area (or substantially the entire area) of the lower surface of the substrates 120, 132 of each patch antenna 104, 108. Additionally, or alternatively, a metallization may be a separate or discrete metallization element abutting against the lower surface of the substrate. Each connector may run through the corresponding substrate to preferably provide a galvanic connection between the antenna structure on the top of the substrate and the metallization on the bottom of the substrate, setting these at equal potential.

In an exemplary embodiment, the antenna assembly 100 may include one or more additional antenna operable in one or more other frequencies or bandwidths besides SDARS and GNSS. For example, the antenna assembly may include a first or primary cellular antenna and a second or secondary cellular antenna. The antenna assembly 100 may be operable as a multiband multiple input multiple output (MIMO) vehicular antenna assembly.

As noted above, the first patch antenna 104 is configured to be operable for receiving SDARS signals (e.g., SiriusXM, etc.). The second patch antenna 108 is configured to be operable for receiving Global Navigation Satellite System (GNSS) signals or frequencies (e.g., Global Positioning System (GPS), BeiDou Navigation Satellite System (BDS), the Russian Global Navigation Satellite System (GLONASS), other satellite navigation system frequencies, etc.).

The SDARS and GNSS patch antennas 104, 108 are in a stacked arrangement with the GNSS patch antenna 108 stacked on top of the SDARS patch antenna 104. Alternatively, the SDARS and GNSS patch antennas 104, 108 may be horizontally spaced apart from each other.

In exemplary embodiments, the SDARS signals may be fed via a coaxial cable to a SDARS radio, which, in turn, may be located in an Instrument Panel (IP) that is independent from a Telematics Control Unit (TCU) box. By way of background, the frequency range or bandwidth of GPS(L1) is 1575.42 MHz±1.023 MHz, the frequency range or bandwidth of BDS(B1) is 1561.098 MHz±2.046 MHz, the frequency range or bandwidth of GLONASS(L1) is 1602.5625 MHz±4 MHz, and the frequency range or bandwidth of SDARS is 2320 MHz to 2345 MHz. Also, for example, the GNSS patch antenna 108 may be operable from about 1558 MHz to about 1608 MHz.

In an exemplary embodiment, the antenna assembly 100 may include a first or primary cellular antenna that is a monopole antenna (e.g., stamped metal wide band monopole antenna mast, etc.) configured to be operable for both receiving and transmitting communication signals within one or more cellular frequency bands (e.g., Long Term Evolution (LTE), etc.). The first cellular antenna may be connected to and supported by a printed circuit board (PCB). For example, the first cellular antenna may have one or more bent or formed tabs at the bottom, which may provide areas for soldering the first cellular antenna to the PCB. The first cellular antenna may also include a downwardly extending projection that may be at least partially received within a corresponding opening in the PCB, for example, to make electrical connection to a PCB component on the opposite side of the PCB. Alternatively, other embodiments may include other means for soldering or connecting the first cellular antenna to the PCB.

The PCB may be supported by a chassis or body. The PCB may be mechanically fastened via fasteners (e.g., screws, etc.) to the chassis.

In an exemplary embodiment, the antenna assembly 100 may also include a second or secondary cellular antenna configured to be operable for receiving (but not transmitting) communication signals within one or more cellular frequency bands (e.g., LTE, etc.). In alternative embodiments, a second cellular antenna may be configured to transmit in a different channel (Dual Channel feature) or transmit at the same channel but at a different time slot (Tx Diversity).

The second cellular antenna may be supported and held in position by a support, which may comprise plastic or other dielectric material. The second cellular antenna may include downwardly extending portions, legs, or shorts configured to be slotted or extended into holes in the PCB for connection (e.g., solder, etc.) to a feed network. The second cellular antenna may comprise stamped and bent sheet metal. Alternative embodiments may include a second cellular antenna that is configured differently (e.g., inverted L antenna (ILA), planar inverted F antenna (PIFA), an antenna made of different materials and/or via different manufacturing processes, etc.). The second cellular antenna may be connected to and supported by the printed circuit board (PCB) by, for example, soldering, etc.

A radome or cover may be used to help protect the various components of the antenna assembly 100 enclosed within an interior spaced defined by the radome and a chassis. For example, the radome may substantially seal the components of the antenna assembly 100 within the radome thereby protecting the components against ingress of contaminants (e.g., dust, moisture, etc.) into an interior enclosure of the radome. In addition, the radome may have an aerodynamic shark-fin configuration. The radome may be opaque, translucent, transparent, and/or be provided in a variety of colors. In other example embodiments, antenna assemblies may include covers having a different configuration. The radome may be formed from a wide range of materials, such as, for example, polymers, urethanes, plastic materials (e.g., polycarbonate blends, Polycarbonate-Acrylnitril-Butadien-Styrol-Copolymer (PC/ABS) blend, etc.), glass-reinforced plastic materials, thermoplastic materials, synthetic resin materials, etc. within the scope of the present disclosure.

The radome may be configured to fit over the patch antennas 104, 108 and one or more other antennas, if any, of the antenna assembly 100, such that the antennas 104, 108 are colocated under the radome. The radome may be configured to be secured to a chassis of the antenna assembly 100. In an exemplary embodiment, the radome may be secured to the chassis by mechanical fasteners (e.g., screws, etc.). Alternatively, the radome may be secured to a chassis via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc.

The chassis or base may be configured to couple to a roof of a car for installing the antenna assembly 100 to the car. Alternatively, the radome may connect directly to the roof of a car within the scope of the present disclosure. The antenna assembly 100 may be mountable to an automobile roof, hood, trunk (e.g., with an unobstructed view overhead or toward the zenith, etc.) where the mounting surface of the automobile acts as a ground plane for the antenna assembly.

Exemplary embodiments are disclosed of vehicular antenna assemblies. In an exemplary embodiment, the vehicular antenna assembly generally includes a first satellite antenna configured to be operable for receiving first satellite signals; a second satellite antenna configured to be operable for receiving second satellite signals different than the first satellite signals received by the first satellite antenna; and a reflector positioned generally between the first and second satellite antennas and configured to be operable for reflecting the first satellite signals generally towards the first satellite antenna.

The first satellite antenna may comprise a first patch antenna including a dielectric substrate and an antenna structure on the dielectric substrate. The second satellite antenna may comprise a second patch antenna including a dielectric substrate and an antenna structure on the dielectric substrate. The reflector may be positioned generally between the first and second patch antennas.

The second patch antenna may be stacked on top of the first patch antenna such that the reflector is positioned generally between a lower surface of the dielectric substrate of the second patch antenna and an upper surface of the antenna structure of the first patch antenna.

The reflector may include an electrically-conductive surface that is substantially planar and substantially parallel with the antenna structure of the first patch antenna. The electrically-conductive surface of the reflector may be operable for reflecting the first satellite signals generally towards the antenna structure of the first patch antenna.

The electrically-conductive surface of the reflector may have a surface area larger than a surface area of the antenna structure of the first patch antenna.

The first patch antenna may be configured to be operable for receiving satellite digital audio radio services (SDARS) signals and/or with frequencies from 2320 MHz to 2345 MHz. The second patch antenna may be configured to be operable for receiving Global Navigation Satellite System (GNSS) signals or frequencies and/or with frequencies from 1558 MHz to 1608 MHz.

The reflector may comprise an electrically-conductive circular plate.

The reflector may be coupled to the first satellite antenna. For example, the reflector may be mechanically fastened to the first satellite antenna with one more mechanical fasteners (e.g., with a single screw, etc.).

The reflector may include a fastener hole. The first satellite antenna may include a fastener hole aligned with the fastener hole of the reflector. The reflector may be mounted to the first satellite antenna with a single mechanical fastener inserted through the aligned fastener holes of the reflector and the first satellite antenna.

The vehicular antenna assembly may be configured to be installed and fixedly mounted to a body wall of a vehicle after being inserted into a mounting hole in the body wall from an external side of the vehicle and nipped from an interior compartment side of the vehicle.

In an exemplary embodiment, a stacked patch antenna assembly generally includes a first patch antenna configured to be operable for receiving first signals, a second patch antenna configured to be operable for receiving second signals different than the first signals received by the first patch antenna, and a reflector configured to be operable for reflecting the first signals generally towards the first patch antenna. The second patch antenna may be stacked on top of the first patch antenna such that the reflector is positioned generally between the first and second patch antennas.

The first patch antenna may include a dielectric substrate and an antenna structure on the dielectric substrate. The second patch antenna may include a dielectric substrate and an antenna structure on the dielectric substrate. The reflector may be positioned generally between a lower surface of the dielectric substrate of the second patch antenna and an upper surface of the antenna structure of the first patch antenna.

The reflector may include an electrically-conductive surface that is substantially planar and substantially parallel with the antenna structure of the first patch antenna. The electrically-conductive surface of the reflector may be operable for reflecting the first signals generally towards the antenna structure of the first patch antenna.

The electrically-conductive surface of the reflector may have a surface area larger than a surface area of the antenna structure of the first patch antenna.

The first patch antenna may be configured to be operable for receiving satellite digital audio radio services (SDARS) signals and/or with frequencies from 2320 MHz to 2345 MHz. The second patch antenna may be configured to be operable for receiving Global Navigation Satellite System (GNSS) signals or frequencies and/or with frequencies from 1558 MHz to 1608 MHz.

The reflector may comprise an electrically-conductive circular plate.

The reflector may be coupled to the first patch antenna. For example, the reflector may be mechanically fastened to the first patch antenna with one more mechanical fasteners (e.g., with a single screw, etc.).

The reflector may include a fastener hole. The first patch antenna may include a fastener hole aligned with the fastener hole of the reflector. The reflector may be mounted to the first patch antenna with a single mechanical fastener inserted through the aligned fastener holes of the reflector and the first patch antenna.

A vehicular antenna assembly may include the stacked patch antenna assembly. The vehicular antenna assembly may be configured to be installed and fixedly mounted to a body wall of a vehicle after being inserted into a mounting hole in the body wall from an external side of the vehicle and nipped from an interior compartment side of the vehicle.

Exemplary embodiments are also disclosed of methods relating to a vehicular antenna assembly including first and second patch antennas configured to be operable for receiving respective first and second signals. In an exemplary embodiment, a method generally includes positioning a reflector generally between the first and second patch antennas such that the reflector is operable for reflecting the first signals generally towards the first patch antenna.

The method may include stacking the second patch antenna on top of the first patch antenna such that the reflector is positioned generally between the stacked first and second patch antennas.

The first patch antenna may include a dielectric substrate and an antenna structure on the dielectric substrate. The second patch antenna may include a dielectric substrate and an antenna structure on the dielectric substrate. The method may include stacking the second patch antenna on top of the first patch antenna such that the reflector is positioned generally between a lower surface of the dielectric substrate of the second patch antenna and an upper surface of the antenna structure of the first patch antenna.

The method may include positioning an electrically-conductive surface of the reflector substantially planar and substantially parallel with the antenna structure of the first patch antenna such that the electrically-conductive surface of the reflector is operable for reflecting the first signals generally towards the antenna structure of the first patch antenna.

The first patch antenna may be configured to be operable for receiving satellite digital audio radio services (SDARS) signals and/or with frequencies from 2320 MHz to 2345 MHz. The second patch antenna may be configured to be operable for receiving Global Navigation Satellite System (GNSS) signals or frequencies and/or with frequencies from 1558 MHz to 1608 MHz.

The reflector may comprise an electrically-conductive circular plate. The method may include installing the vehicular antenna assembly to a body wall of a vehicle.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vehicular antenna assembly comprising:

a first satellite antenna configured to be operable for receiving first satellite signals;

a second satellite antenna configured to be operable for receiving second satellite signals different than the first satellite signals received by the first satellite antenna; and a reflector positioned generally between the first and second satellite antennas and configured to be operable for reflecting the first satellite signals generally towards the first satellite antenna;

wherein the vehicular antenna assembly is configured to be installed and fixedly mounted to a body wall of a vehicle after being inserted into a mounting hole in the body wall from an external side of the vehicle and nipped from an interior compartment side of the vehicle.

2. The vehicular antenna assembly of claim 1, wherein:

the first satellite antenna comprises a first patch antenna including a dielectric substrate and an antenna structure on the dielectric substrate;

the second satellite antenna comprises a second patch antenna including a dielectric substrate and an antenna structure on the dielectric substrate; and the reflector is positioned generally between the first and second patch antennas.

3. The vehicular antenna assembly of claim 2, wherein the second patch antenna is stacked on top of the first patch antenna such that the reflector is positioned generally between a lower surface of the dielectric substrate of the second patch antenna and an upper surface of the antenna structure of the first patch antenna.

4. The vehicular antenna assembly of claim 2, wherein the reflector includes an electrically-conductive surface that is substantially planar and substantially parallel with the antenna structure of the first patch antenna, whereby the electrically-conductive surface of the reflector is operable for reflecting the first satellite signals generally towards the antenna structure of the first patch antenna.

5. The vehicular antenna assembly of claim 4, wherein the electrically-conductive surface of the reflector has a surface area larger than a surface area of the antenna structure of the first patch antenna.

6. The vehicular antenna assembly of claim 1, wherein:

the first satellite antenna is configured to be operable for receiving satellite digital audio radio services (SDARS) signals and/or with frequencies from 2320 MHz to 2345 MHz; and the second satellite antenna is configured to be operable for receiving Global Navigation Satellite System (GNSS) signals or frequencies and/or with frequencies from 1558 MHz to 1608 MHz.

7. The vehicular antenna assembly of claim 1, wherein:

the reflector comprises an electrically-conductive circular plate; and the reflector is mechanically fastened to the first satellite antenna with one or more mechanical fasteners.

8. The vehicular antenna assembly of claim 1, wherein:

the reflector comprises an electrically-conductive circular plate; or the reflector is mechanically fastened to the first satellite antenna with one or more mechanical fasteners.

9. A vehicular antenna assembly comprising a stacked patch antenna assembly comprising:

a first patch antenna configured to be operable for receiving first signals;

a second patch antenna configured to be operable for receiving second signals different than the first signals received by the first patch antenna; and a reflector configured to be operable for reflecting the first signals generally towards the first patch antenna;

wherein the second patch antenna is stacked on top of the first patch antenna such that the reflector is positioned generally between the first and second patch antennas; and wherein the vehicular antenna assembly is configured to be installed and fixedly mounted to a body wall of a vehicle after being inserted into a mounting hole in the body wall from an external side of the vehicle and nipped from an interior compartment side of the vehicle.

10. The vehicular antenna assembly of claim 9, wherein:

the first patch antenna includes a dielectric substrate and an antenna structure on the dielectric substrate;

the second patch antenna includes a dielectric substrate and an antenna structure on the dielectric substrate; and the reflector is positioned generally between a lower surface of the dielectric substrate of the second patch antenna and an upper surface of the antenna structure of the first patch antenna.

11. The vehicular antenna assembly of claim 10, wherein the reflector includes an electrically-conductive surface that is substantially planar and substantially parallel with the antenna structure of the first patch antenna, whereby the electrically-conductive surface of the reflector is operable for reflecting the first signals generally towards the antenna structure of the first patch antenna.

12. The vehicular antenna assembly of claim 11, wherein the electrically-conductive surface of the reflector has a surface area larger than a surface area of the antenna structure of the first patch antenna.

13. The vehicular antenna assembly of claim 9, wherein:

the first patch antenna is configured to be operable for receiving satellite digital audio radio services (SDARS) signals and/or with frequencies from 2320 MHz to 2345 MHz; and the second patch antenna is configured to be operable for receiving Global Navigation Satellite System (GNSS) signals or frequencies and/or with frequencies from 1558 MHz to 1608 MHz.

14. The vehicular antenna assembly of claim wherein:

the reflector comprises an electrically-conductive circular plate; and the reflector is mechanically fastened to the first patch antenna with one or more mechanical fasteners.

15. The vehicular antenna assembly of claim 9, wherein:

the reflector comprises an electrically-conductive circular plate; or the reflector is mechanically fastened to the first patch antenna with one or more mechanical fasteners.

16. A method relating to a vehicular antenna assembly including first and second patch antennas configured to be operable for receiving respective first and second signals, the method comprising positioning a reflector generally between the first and second patch antennas such that the reflector is operable for reflecting the first signals generally towards the first patch antenna; and installing and fixedly mounting the vehicular antenna assembly to a body wall of a vehicle by inserting the vehicle antenna assembly inserted into a mounting hole in the body wall from an external side of the vehicle and nipping the vehicle antenna assembly from an interior compartment side of the vehicle.

17. The method of claim 16, wherein the method includes stacking the second patch antenna on top of the first patch antenna such that the reflector is positioned generally between the stacked first and second patch antennas.

18. The method of claim 16, wherein:

the first patch antenna includes a dielectric substrate and an antenna structure on the dielectric substrate;

the second patch antenna includes a dielectric substrate and an antenna structure on the dielectric substrate; and the method includes stacking the second patch antenna on top of the first patch antenna such that the reflector is positioned generally between a lower surface of the dielectric substrate of the second patch antenna and an upper surface of the antenna structure of the first patch antenna.

19. The method of claim 18, wherein the method includes positioning an electrically-conductive surface of the reflector substantially planar and substantially parallel with the antenna structure of the first patch antenna such that the electrically-conductive surface of the reflector is operable for reflecting the first signals generally towards the antenna structure of the first patch antenna.

20. The method of claim 18, wherein:

the first patch antenna is configured to be operable for receiving satellite digital audio radio services (SDARS) signals and/or with frequencies from 2320 MHz to 2345 MHz; and the second patch antenna is configured to be operable for receiving Global Navigation Satellite System (GNSS) signals or frequencies and/or with frequencies from 1558 MHz to 1608 MHz.

* * * * *